US005429540A

United States Patent [19]

Anzai et al.

[11] Patent Number: 5,429,540

[45] Date of Patent: Jul. 4, 1995

[54] BEADING APPARATUS FOR ELECTRON GUN AND METHOD OF ATTACHING BEADING

[75] Inventors: Hiroki Anzai; Masanori Ogiya, both of Fukusima, Japan

[73] Assignee: Sony Corporation, Tokyo, Japan

[21] Appl. No.: 274,700

[22] Filed: Jul. 14, 1994

[30] Foreign Application Priority Data

Jul. 16, 1993 [JP] Japan ..... 5-176853

[51] Int. Cl.[6] ..... H01J 9/18

[52] U.S. Cl. ..... 445/34; 445/67

[58] Field of Search ..... 445/34, 67

[56] References Cited

U.S. PATENT DOCUMENTS 3,516,131 6/1970 Yoshida et al. ..... 445/67
3,598,557 8/1971 Sawagata et al. ..... 445/67

FOREIGN PATENT DOCUMENTS 0158388 10/1985 European Pat. Off. .
59-105237 6/1984 Japan ..... 445/34
2-21535 1/1990 Japan ..... 445/34
6-20594 1/1994 Japan ..... 445/34

OTHER PUBLICATIONS

*Patent Abstracts of Japan*, vol. 10, No. 313, "Assembling Device for Electron Gun Structure", 24 Oct. 1986.

*Primary Examiner*—P. Austin Bradley
*Assistant Examiner*—Jeffrey T. Knapp
*Attorney, Agent, or Firm*—Hill, Steadman & Simpson

[57] ABSTRACT

In assembling an electron gun (10), parts (11 to 18) are placed on supports (21) on the support base (2). The angle of a supported G3 grid (15) can be adjusted by moving the side of the G3A grid (15A), because the support (21) for the G3 grid (15) holds only the rear of the G3B grid (15B). Accordingly, in the event the G3A grid (15A) and the G3B grid (15B) are welded together out of position, adjuster pins (5) can be inserted into the guide holes (61) of the G3A grid (15A) without being bent, thereby adjusting beam holes (62) of G3A grid (15A) to coincide with the beam holes (62) of other grids. Accordingly, the beading apparatus (1) allows the electron gun (10) to be manufactured with considerable precision.

3 Claims, 5 Drawing Sheets

BEADING APPARATUS FOR ELECTRON GUN AND METHOD OF ATTACHING BEADING

BACKGROUND OF THE INVENTION

1. Field of the Invention

The present invention relates to a beading apparatus for attaching beadings to parts of an electron gun.

2. Description of the Related Art

In an electron gun for a cathode-ray tube, dimensions, relative positions and intervals of respective grids are manufactured with considerable precision in order to improve the focus function.

FIG. 4 illustrates the structure of an unipotential electron gun 10. In the electron gun 10, a support pin 11, grids 12 to 17, and a convergence plate 18 are arranged in a single row. Two long and slender beadings 20 adhere to pins 19 protruding from the sides of the respective parts 11 to 18. The beadings 20 hold the parts 11 to 18 firmly together.

In assembling the electron gun 10, as shown in FIG. 5, the parts 11 to 18 are placed onto supports 21 which are set on top of a support base 2 for the beading apparatus 1. A first spacer 22, a second spacer 23, and a third spacer 24, which have a predetermined thickness, protrude from the support base 2. The first spacer 22 is inserted between GM grid 14 and G3 grid 15, the second spacer 23 is inserted between G3 grid 15 and G4 grid 16, and the third spacer 24 is inserted between G4 grid 16 and G5 grid 17. Accordingly, the parts 11 to 18 can be fixed at predetermined intervals.

Further, a stabilizing lever 3 is mounted on one of two legs 25 rotatably by shaft 32. When pushed down, the stabilizing lever 3 is fixed by a clamp 4 mounted on the other leg 25 rotatably by shaft 41. The G5 grid 17 is fixed by holders 31 set on the lower side of the stabilizing lever 3 in connection with the supports 21 on the support base 2. Each of the parts 11 to 16 are held firmly in their proper positions but may be slided. Thereafter an appropriate pressing means (not shown) presses the support pin 11 in the direction of the G5 grid 17. With this, parts 11 to 18 of the electron gun 10 are firmly manufactured at predetermined intervals.

As shown in FIG. 6, two guide holes 61, being diametrically opposite each other, are perforated from the support pin 11 to the G3A grid 15A for adjusting the positions of the parts. Two adjuster pins 5 are inserted into the guide holes 61 through the parts, so that the positions of the parts 11 to 15 are adjusted on opposite sides and three beam holes 62, perforated from the G1 grid 12 to the G3 grid 15A, coincide respectively. Therefore the electron gun 10 can emit three lines of electron beams precisely at a target.

After the insertion of the adjuster pins 5, two beadings 20 are attached to the pins 19 for the parts 11 to 18. The beadings 20 combine the parts 11 to 18 in proper position and at predetermined intervals. Thereafter, the assembled electron gun 10 is removed from the support base 2, and the adjuster pins 5 are pulled out. At this point the assemblage of the electron gun 10 is completed.

In this case, for manufacturing reasons, G3A grid 15A and G3B grid 15B are manufactured separately, and, are welded together as the G3 grid 15. The G3A grid 15A is formed into a flat plate, and as shown in FIG. 6, has the guide hole 61 for adjustment of the position diametrically and the beam hole 62 for electron beam to pass through. The G3B grid 15B is formed into a cylindrical shape.

In the beading apparatus 1 for the electron gun 10 described above, the supports 21, on which the G3 grid 15 is placed, hold the whole G3B grid 15B. Therefore, in the event the G3A grid 15A and the G3B grid 15B are welded together out of position, when the G3 grid 15 is placed on the supports 21, both the guide hole 61 and the beam hole 62 of the G3A grid 15A are also out of position.

Large discordance of the guide holes 61 inhibits the adjuster pins 5 from being inserted. Small discordance, as shown in FIG. 7, may allow the adjuster pins 5 to be inserted into the guide holes 61 if the adjuster pins 5 are bent slightly. In the latter case, the beadings 20 are attached to the parts 11 to 15 on the assumption that the parts 11 to 15 are in proper position. This poor condition prevents the electron gun 10 from emitting an electron beam precisely at the target because the beam holes 62 of the G3; A grid 15A do not coincide with the beam holes 62 of the grids 12 to 14.

After the beadings 20 are attached, the discordance of the beam holes 62 of the G3A grid 15A can be corrected so as to correspond to the beam holes 62 of the grids 12 to 14 by inclining the G3 grid 15 forcibly. But the problem remains that it is difficult to adjust the position completely and that it takes a good deal of time and labor.

OBJECT AND SUMMARY OF THE INVENTION

As shown in FIG. 1, in assembling the electron gun 10, the parts 11 to 18 are placed on the supports 21. The support angle of the G3 grid 15 can be adjusted by moving the side of the G3A grid 15A, because the supports 21 for the G3 grid 15 holds the rear of the G3B grid 15B.

Accordingly, as shown in FIG. 2, in the event the G3A grid 15A and the G3B grid 15B are welded out of position, the adjuster pins 5 can be inserted into the guide holes 61 through vertical slits 22A of the first spacer 22 without being bent. The beam holes 62 of the G3A grid 15A therefore coincide with the beam holes 62 of the other grids 12 to 14. This improved beading apparatus 1 allows the electron gun 10 to be manufactured with considerable precision.

It is accordingly an object of the invention to provide an improved beading apparatus for an electron gun, wherein the beam holes 62 of the G3A grid can be adjusted to coincide with the other beam holes 62 in the event the G3A grid and the G3B grid are welded together out of position.

These and other objects and many of the attendant advantages of this invention will be readily appreciated as the same becomes better understood by reference to the following detailed description when considered in conjunction with the accompanying drawings.

DESCRIPTION OF THE PREFERRED EMBODIMENT

A preferred embodiment of a beading apparatus 1 for an electron gun, according to this invention, will be described below with reference to the drawings.

Figure 1:
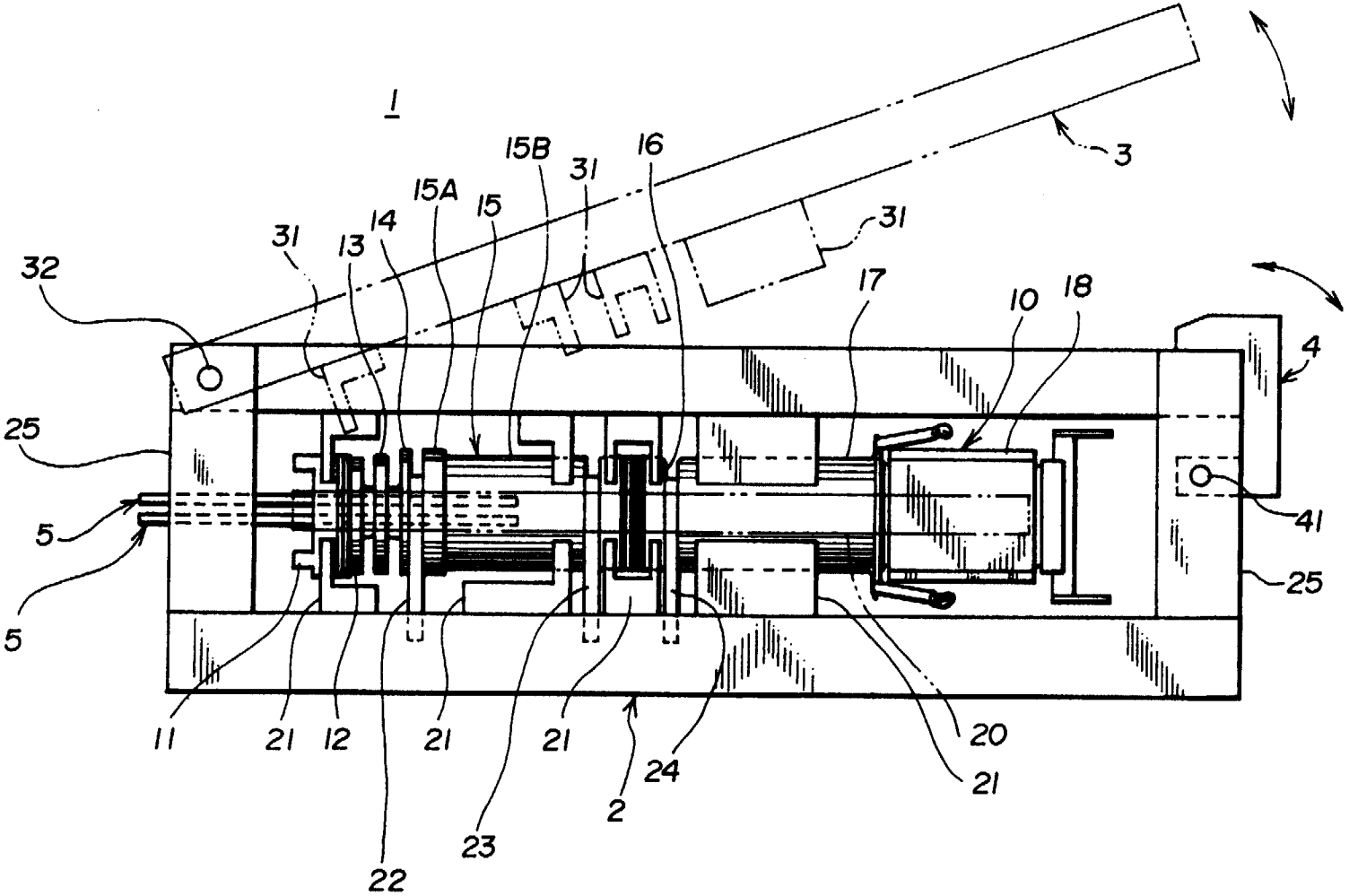
FIG. 1 is a diagram illustrating the construction of a beading apparatus 1 for an electron gun in accordance with the present invention.
Figure 5:
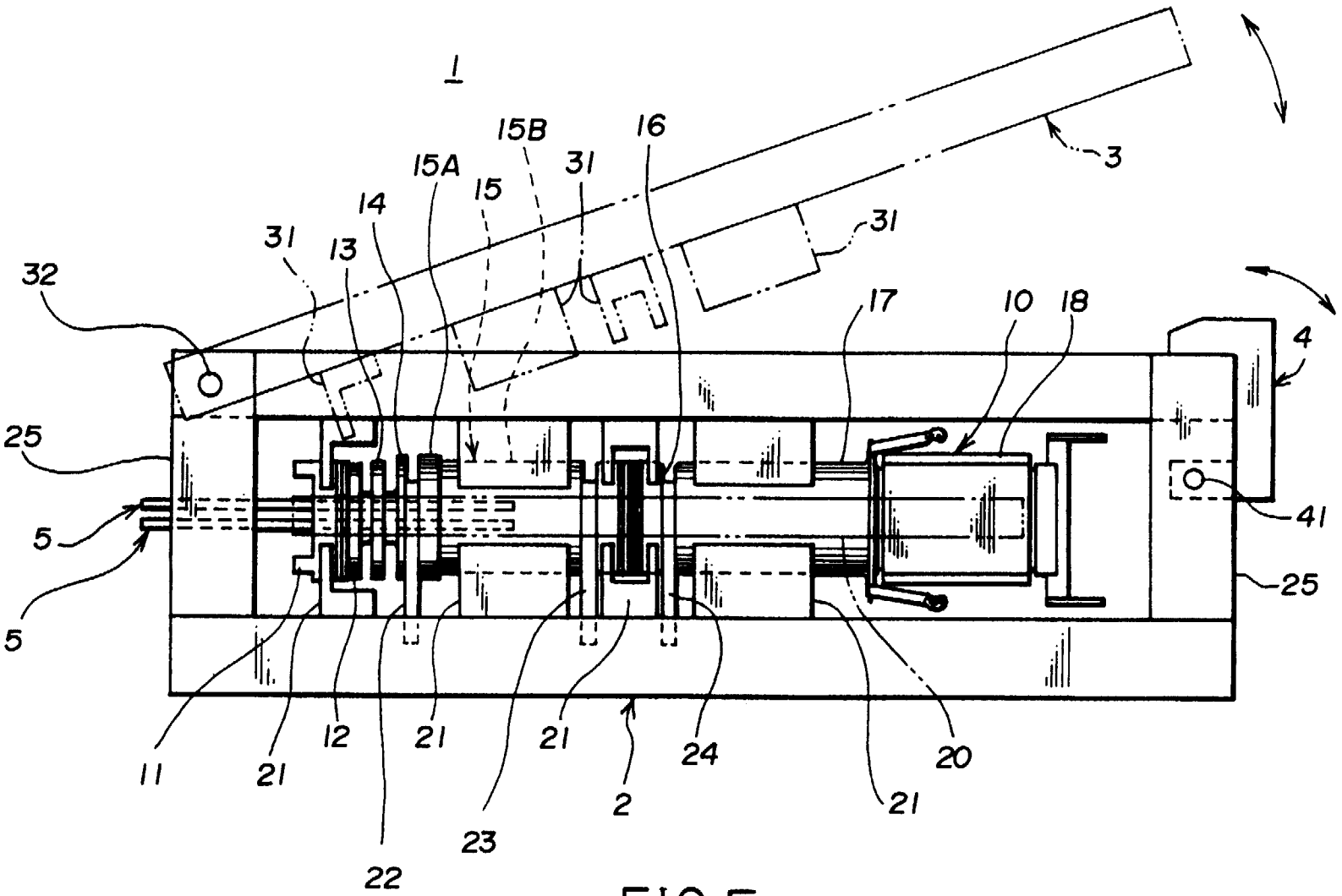
FIG. 5 (Related Art)
FIG. 5 is a diagram illustrating the construction of a beading apparatus 1 for an electron gun.
Figure 6:
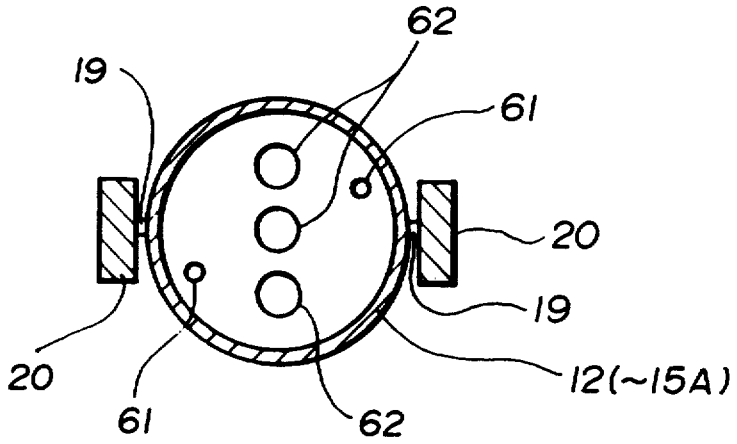
FIG. 6 (RELATED ART)
FIG. 6 is a sectional diagram illustrating the positions of beam holes 62 and guide holes 61 of the respective grids 12 to 15.
Figure 7:
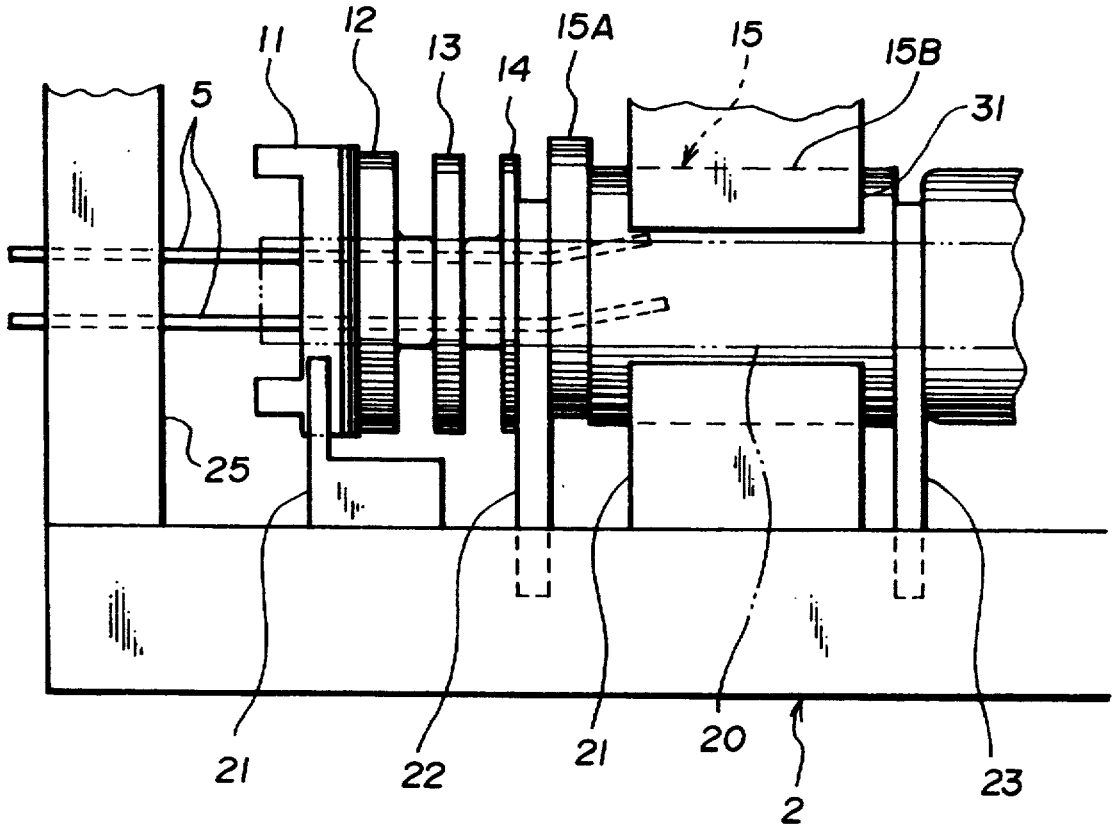
FIG. 7 (Related Art)
FIG. 7 is a diagram for explaining a G3 grid 15 in proper position for assembly in a beading apparatus 1.

FIG. 1 illustrates the structure of a beading apparatus 1 for an electron gun 10 in accordance with this invention. As shown in FIG. 5, the beading apparatus 1 comprises a support base 2, a stabilizing lever 3 and a clamp 4. The support base 2 holds parts 11 to 18 of the electron gun 10 in proper position for assembly. The stabilizing lever 3 presses on the upper side of the parts 11 to 18 to keep them in position. The clamp 4 is mounted rotatably on one edge of the support base 2 for maintaining the stabilizing lever 3 in a position to hold the electron gun 10.

On the support base 2, supports 21 are formed into arc shapes so as to correspond to the radiuses of the parts 11 to 17. The support pin 11 and grids 15 to 17 can be firmly placed upon the supports 21. A first spacer 22 is inserted between the GM grid 14 and the G3 grid 15, a second spacer 23 is inserted between the G3 grid 15 and the G4 grid 16, and a third spacer 24 is inserted between the G4 grid 16 and the G5 grid 17. Accordingly the parts 11 to 18 are fixed at predetermined intervals.

Further, two legs 25 stand vertically at both sides of the support base 2 for mounting the stabilizing lever 3 and the clamp 4. The stabilizing lever 3 is mounted on the left leg 25 rotatably by a shaft 32. Holders 31 are mounted on the lower side of the stabilizing lever 3 for holding the parts 11 to 18 in position, and correspond to the supports 21 respectively on the support base 2. Springs (not shown) intervene between the holders 31 and the support base 2 so that diameters of the support pin 11 and the grids 15 to 17 may be changed.

The clamp 4 is formed into a U-shape, and the lower part of the clamp 4 is mounted on the right leg 25 rotatably by a shaft 41. By hooking the upper part of the clamp 4 on the stabilizing lever 3, the clamp 4 maintains the stabilizing lever 3 in a position to hold parts 11 to 18 of the electron gun 10.

Figure 2:
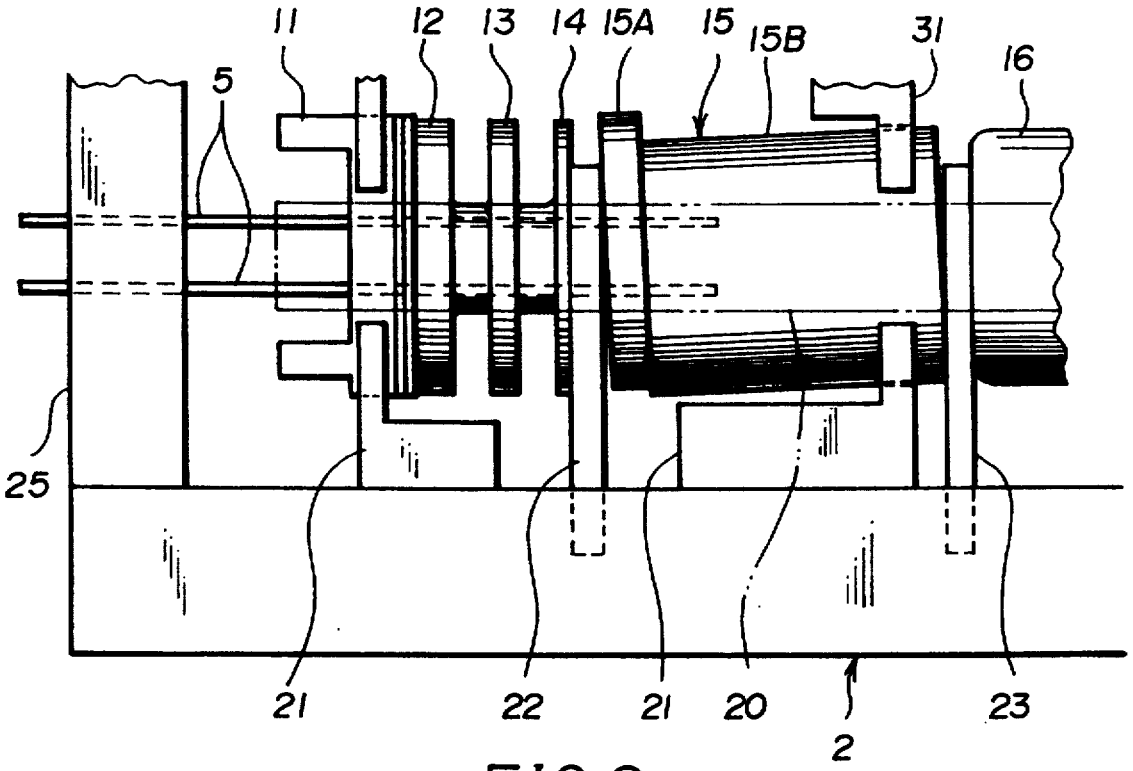
FIG. 2 is a diagram explaining a G3 grid in proper position for assembly in the beading apparatus 1 for the electron gun in accordance with the invention.
Figure 3:
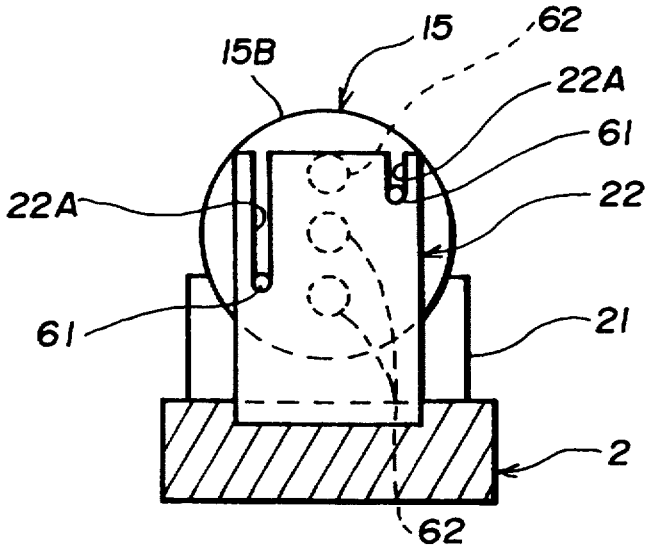
FIG. 3 is a front diagram illustrating the shape of the first spacer 22.
Figure 4:
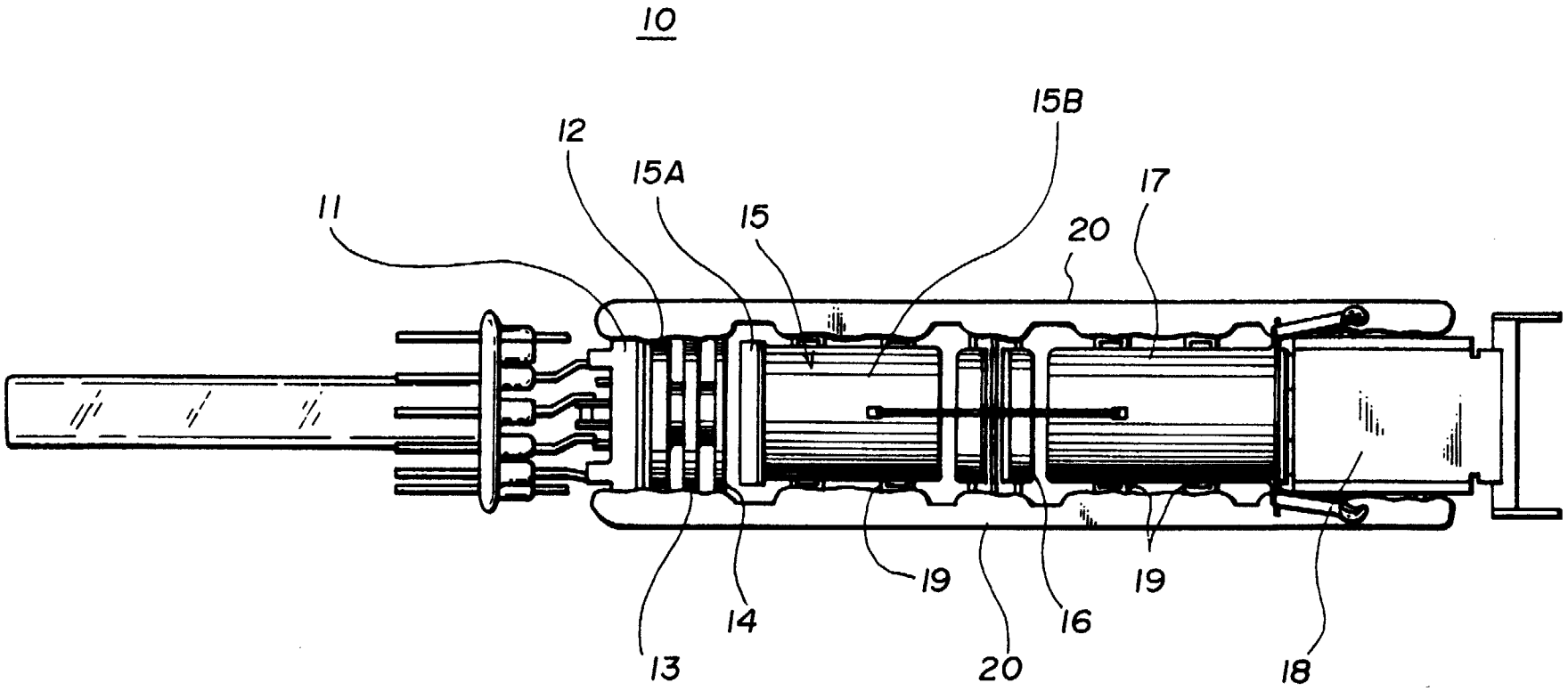
FIG. 4 (RELATED ART)
FIG. 4 is a diagram illustrating a construction of a typical electron gun 10.

In the beading apparatus 1 for the electron gun, as shown in FIG. 2, the support 21 for G3 grid 15 holds only the rear of the G3B grid 15B. Similarly, the holder 31 for the G3 grid 15 also holds only the rear of the G3B grid 15B. As shown in FIG. 3, two vertical slits 22A are made in the spacer 22 placed in front of the G3B grid 15B for the insertion of two adjuster pins 5.

As shown in FIG. 2, in case the G3A grid 15A and the G3B grid 15B are welded out of position, the position of the G3A grid 15A can be adjusted when the adjuster pins 5 are inserted into the guide holes 61, because only the rear of the G3B grid 15B is held by the support 21 and the holder 31.

Then, with the adjuster pins 5 straight through the vertical slits 22A of the first spacer 22, the beam holes 62 of the G3 grid 15B are arranged in proper position and coincide with the other beam holes 62 of the grids 12 to 14. Accordingly, the electron gun can emit electron beam precisely at a target.

The embodiment relates to the assembling of an unipotential electron gun 10. This invention can be also applied to a beading apparatus for a bi-potential electron gun and so on.

While the preferred embodiment of the invention has been described above, it will be understood that various modifications may be made therein, and the invention is intended to cover with the appended claims all such modifications as may fall within the true spirit and scope of the invention.

What is claimed is:

1. A beading apparatus for an electron gun for attaching a beading to parts of said electron gun in order to fix said parts, said beading apparatus comprising:
   - a plurality of supports for supporting said parts in proper position for assembly;
   - a support base having a plurality of spacers for holding parts at predetermined intervals;
   - said supports for a third grid supporting only the rear of said third grid;
   - a one of said spacers placed between a second grid and said third grid wherein said one of said spacers has a vertical slit for receiving an adjuster pin in order to allow arrangement of said parts in proper position; and
   - means for attaching said beading to said parts after inserting said adjuster pin into a guide hole, made on the front side of said third grid, through said vertical slit.

2. A beading apparatus in accordance with claim 1 wherein said support base further comprises;
   - a stabilizing lever having a plurality of holders in accordance with said supports for holding said parts;
   - a clamp mounted rotatably on one side of said support base for holding said stabilizing lever so that said stabilizing lever holds said electron gun;
   - a leg for supporting said adjuster pin;
   - said holders for said third grid holding only said rear of said third grid;
   - said supports and said holders being formed into arc shapes corresponding to said parts respectively.

3. A method of attaching a beading to parts of said electron gun in order to fix said parts, comprising the steps of;
   - placing said parts of said electron gun onto a plurality of supports for supporting said parts in proper position for assembly and onto a support base having a plurality of spacers for holding parts at predetermined intervals wherein a one of said spacers is placed between a second grid and a third grid;
   - inserting an adjuster pin into a vertical slit made in said one of said spacers and into a guide hole made on a front side of said third grid, in order to arrange said parts in proper position;
   - with said supports for said third grid supporting only a rear of said third grid; and
   - attaching said beading to said parts after said adjuster pin is inserted into said vertical slit and said guide hole.

* * * * *